United States Patent [19]

Rockwell

[11] 3,941,107

[45] Mar. 2, 1976

[54] IGNITION DISTRIBUTOR ROTOR

[75] Inventor: Lynn A. Rockwell, Anderson, Ind.

[73] Assignee: General Motors Corporation, Detroit, Mich.

[22] Filed: Feb. 20, 1975

[21] Appl. No.: 551,380

[52] U.S. Cl. .... 123/146.5 A; 200/19 DR; 200/19 R

[51] Int. Cl.[2] ..... F02P 1/00

[58] Field of Search ..... 123/146.5 A, 146.5 R; 200/19 A, 19 R, 19 DR

[56] References Cited

UNITED STATES PATENTS

| | | | |
|---|---|---|---|
| 2,227,972 | 1/1941 | Hood et al. | 200/19 A |
| 2,286,233 | 6/1942 | Scott | 200/19 WG |
| 2,593,205 | 4/1952 | Short et al. | 200/19 DR |
| 2,694,117 | 11/1954 | Bakke | 200/19 A |
| 3,591,736 | 7/1971 | Morgan et al. | 200/19 DC |
| 3,795,236 | 3/1974 | Jukesl et al. | 123/146.5 |
| 3,799,135 | 3/1974 | House | 123/146.5 |
| 3,822,686 | 7/1974 | Gallo | 123/146.5 |

*Primary Examiner*—Wendell E. Burns
*Assistant Examiner*—James W. Cranson, Jr.
*Attorney, Agent, or Firm*—Richard G. Stahr

[57] ABSTRACT

To reduce the potential magnitude necessary to break down the spark gap between the rectangular cross-section rotor electrode of an ignition distributor rotor having a body member of electrically nonconductive material and each of the output electrodes in the distributor cap, discrete electrically conductive material is placed in intimate electrical contact with a selected area along each opposite edge surface of the rotor electrode and the rotor body to provide electrical interconnection between the rotor electrode and the rotor body.

4 Claims, 4 Drawing Figures

IGNITION DISTRIBUTOR ROTOR

The subject invention is directed to an ignition distributor rotor and, more specifically, to an ignition distributor rotor having the electrically conductive rotor electrode electrically connected to the electrically nonconductive rotor body.

It has been found that the use of the modern, high dielectric strength electrically nonconductive materials for the body member of distributor rotors substantially increases the magnitude of the potential required to ionize and, consequently, break down the spark gap between the rotor electrode supported by the body member and each of the output terminals of the distributor cap. It was also found that excessive radio frequency noise was produced when the potential required to break down each spark gap exceeded approximately 12 kilovolts. Therefore, an ignition distributor rotor having a body member made of a modern, high dielectric strength electrically nonconductive material electrically interconnected with the electrically conductive rotor electrode, an arrangement which reduces the potential magnitude required to break down each ignition distributor spark gap, is desirable.

It is, therefore, an object of this invention to provide an improved ignition distributor rotor.

It is another object of this invention to provide an improved ignition distributor rotor having a body member of a high dielectric strength electrically nonconductive material and an electrically conductive rotor electrode electrically interconnected therewith.

In accordance with this invention, an ignition distributor rotor is provided comprising a body member of electrically nonconductive material carrying a rotor electrode of an electrically conductive material having a tip portion which is passed in spark gap relationship with successive ones of the output terminals supported by the distributor cap as the rotor is rotated and discrete electrically conductive material in intimate electrical contact with both the rotor electrode and the nonconductive rotor body.

For a better understanding of the present invention, together with additional objects, advantages and features thereof, reference is made to the following description and accompanying drawing in which.

In the several FIGURES of the drawing, like elements have been assigned like numerals of reference.

Figure 1:
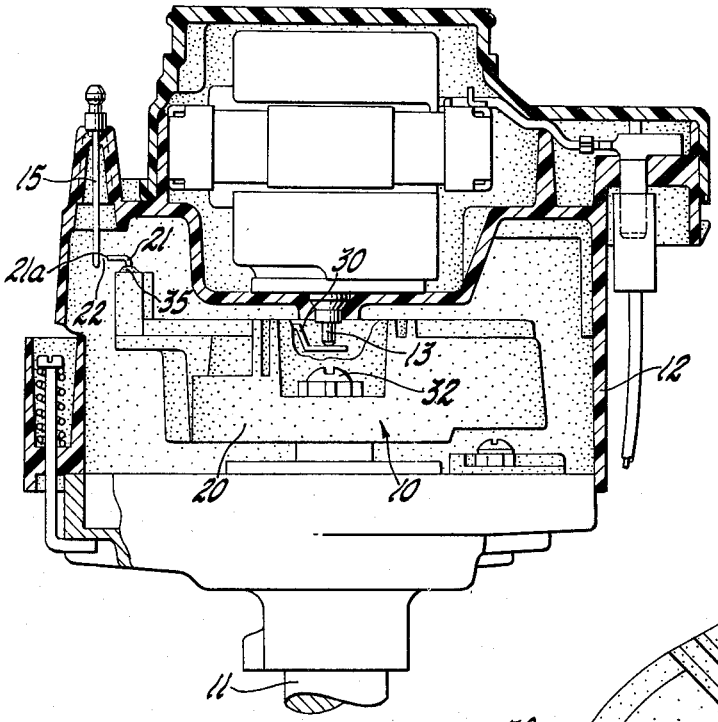
FIG. 1 is a vertical section view of a portion of an ignition distributor showing the distributor rotor member of this invention mounted therein.

As is well known in the automotive art, the ignition distributor rotor 10, FIG. 1, is rotated by a driving shaft 11, usually gear coupled to the camshaft of the associated internal combustion engine, within a distributor cap 12 having a center input terminal 13, to which is connected one end of the associated ignition coil secondary winding, and a plurality of output terminals, one of which is shown at 15, circumferentially arranged about the input terminal 13, to which the spark plugs are connected through respective spark plug leads in a manner well known in the automotive art. Although only one output terminal is shown in FIG. 1, in which the distributor cap 12 is illustrated in cross-section, it is to be specifically understood that an output terminal is provided for each of the engine spark plugs and that they are circumferentially arranged about the center input terminal in a manner well known in the automotive art.

The ignition distributor rotor of this invention comprises a body member 20 of an electrically nonconductive material adapted to engage and be rotated by driving shaft 11, a rotor electrode 21 of an electrically conductive material such as copper supported by body member 20 and having a tip portion 21*a* which is passed in spark gap relationship with successive ones of the output terminals of distributor cap 12 as body member 20 is rotated by shaft 11. Without intention or inference of a limitation thereto, rotor electrode 21 may be of a rectangular cross-section and have opposite flat face surfaces 21*b* and 21*c*, FIG. 3, and opposite edge surfaces 21*d* and 21*e*, FIG. 4. Rotor electrode 21 may be placed in electrical circuit arrangement with center electrode 13 through a contact member 30 of an electrically conductive material such as copper or stainless steel in intimate electrical contact with rotor electrode 21 along adjacent surfaces of both under retaining member 31 and arranged to be electrically connected to center input terminal 13 of distributor cap 12. Alternatively, rotor electrode 21 may be of sufficient length to electrically contact center input terminal 13 without departing from the invention. In a practical application, the electrically nonconductive material of which body member 20 was made was a 30% glass reinforced thermoplastic polyester molding material. Body member 20 may be secured to the distributor centrifugal weight base, not shown, by screws, one of which is illustrated in FIG. 1 and referenced by the numeral 32. As the distributor weight base is rotated by shaft 11 in a manner well known in the art, rotor member 20 is rotated therewith. One example of an ignition distributor with which the distributor rotor of this invention may be used is described in copending U.S. patent application Ser. No. 435,863, R. W. Campbell et al., filed Jan. 23, 1974, and assigned to the same assignee as this application. It is to be specifically understood, however, that any other arrangement through which body member 20 is adapted to engage and be rotated by driving shaft 11 may be employed without departing from the spirit of this invention.

Figure 2:
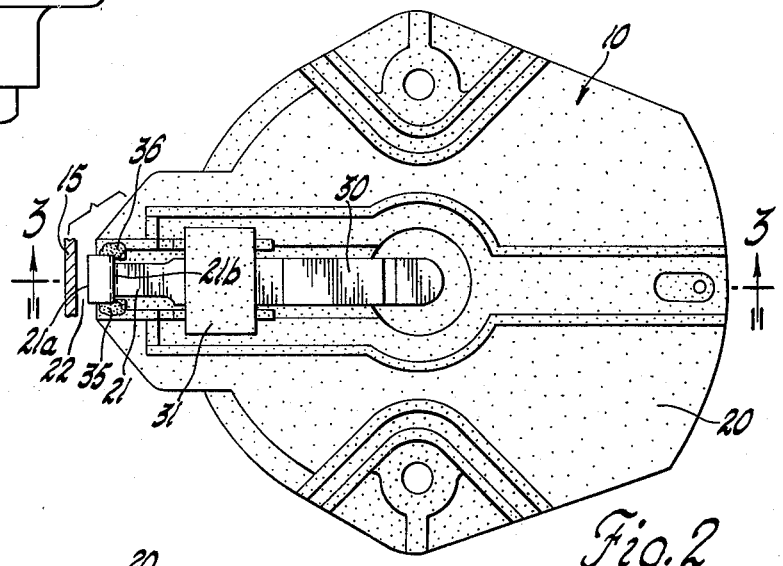
FIG. 2 is a top view of the distributor rotor of this invention showing, in addition, the relationship between the rotor tip and one of the distributor output terminals.
Figure 3:
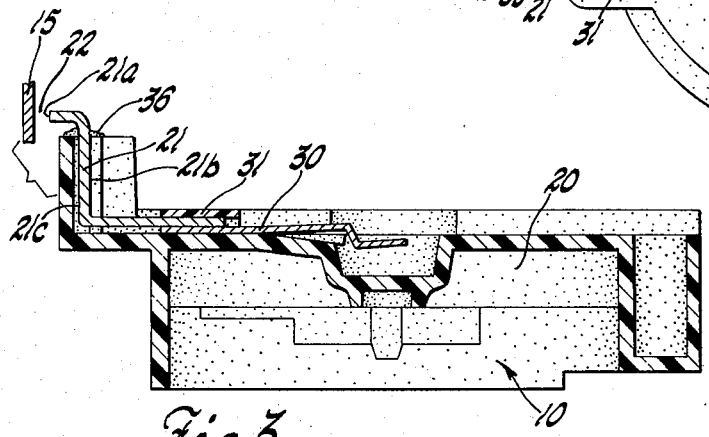
FIG. 3 is a section view of FIG. 2 taken along line 3—3 and looking in the direction of the arrows.
Figure 4:
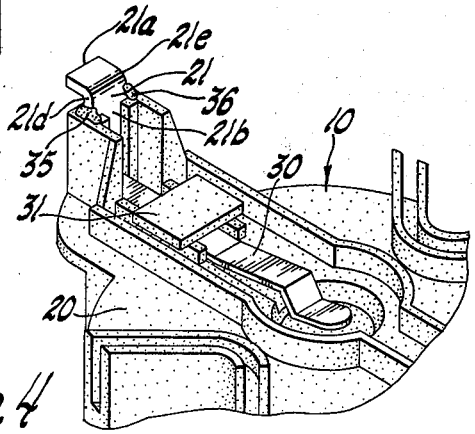
FIG. 4 is a perspective view of a portion of the distributor rotor of this invention.

In the preferred embodiment illustrated in the drawing, contact member 30 is shown to be an elongated contact member of an electrically conductive material such as copper or stainless steel in intimate electrical contact with rotor electrode 21 with one end thereof arranged to be electrically connected to center input terminal 13 of distributor cap 12. With this arrangement, the ignition spark potential produced by the secondary winding of the associated ignition coil may be delivered to successive ones of the distributor cap output terminals as rotor body member 20 is rotated by shaft 11 in timed relationship with the associated internal combustion engine, in a manner well known in the automotive art, through center input terminal 13, contact member 30, rotor electrode 21 and the distributor spark gap between spark gap electrode 21 and each of the distributor output terminals. A distributor spark gap is shown in FIGS. 1, 2 and 3 of the drawing and is identified by the reference numeral 22.

To reduce the potential required to ionize the distributor spark gaps and thus reduce the radiated radio frequency interference, a discrete electrically conductive element or elements may be placed in intimate electrical contact with rotor electrode 21 and body member 20 for electrically interconnecting the rotor electrode 21 and body member 20. For example, the discrete electrical conductive elements may be in intimate electrical contact with a selected area along each of the opposite edge surfaces 21*d* and 21*e* of rotor electrode 21 and body member 30. One example, and without intention or inference of a limitation thereto, of these electrical conductive elements 35 and 36, best illustrated in FIGS. 2 and 4, may be a silver filled paint of sufficient thickness to not only be electrically bonded to both rotor electrode 21 and body member 20 but also to electrically bridge the space therebetween for electrically interconnecting rotor electrode 21 and body member 20. One example of a silver filled paint suitable for this purpose is marketed by Dynaloy, Inc. and is identified as "Dynaloy 340." It is to be specifically understood, however, that any other electrically conductive element or elements may be employed to provide at least one electrical connection between rotor electrode 21 and body member 20 without departing from the spirit of the invention.

It is believed that when a high dielectric strength electrically nonconductive material is employed as body member 20, the body member holds an electrostatic charge because of its extremely high resistance characteristics. It is believed that the larger positive ions are stored on the rotor in the vicinity of the spark gap electrode and are not discharged or bled away by the high dielectric strength material used as the body portion. Consequently, as the rotor voltage builds up for the next spark, the positive ions which approach the rotor tip are repelled by the positive ions stored on the high dielectric material of body member 20 which causes the sparking potential to increase to a higher level to fire the gap. These stored positive ions are apparently dispersed by the electrical interconnection between the rotor body and the rotor electrode, a condition which reduces the required potential to ionize and break down the arc gap.

In a practical application of the rotor of this invention, the required breakdown potential was below 12 kilovolts which provided a significant reduction of radiated radio frequency interference.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. An ignition distributor rotor of the type which is rotated by a driving shaft within a distributor cap having a center input terminal and a plurality of output terminals circumferentially arranged about the input terminal comprising: a body member of an electrically nonconductive material adapted to be rotated by said driving shaft, a rotor electrode of an electrically conductive material in electrical circuit arrangement with said center input terminal and supported by said body member, said rotor electrode having a tip portion which is passed in spark gap relationship with successive ones of said output terminals as said body member is rotated by said shaft; and discrete electrically conductive means in bonded electrical contact with a selected area along opposite sides of said rotor electrode and said body member for electrically interconnecting said rotor electrode and said body member.

2. An ignition distributor rotor of the type which is rotated by a driving shaft within a distributor cap having a center input terminal and a plurality of output terminals circumferentially arranged about the input terminal comprising: a body member of an electrically nonconductive material adapted to be rotated by said driving shaft; a rotor electrode of an electrically conductive material, having opposite flat face surfaces and opposite edge surfaces, in electrical circuit arrangement with said center input terminal and supported by said body member, said rotor electrode having a tip portion which is passed in spark gap relationship with successive ones of said output terminals as said body member is rotated by said shaft; and discrete electrically conductive means in intimate electrical contact with a selected area along each of said opposite edge surfaces of said rotor electrode and said body member for electrically interconnected said rotor electrode and said body member.

3. An ignition distributor rotor of the type which is rotated by a driving shaft within a distributor cap having a center input terminal and a plurality of output terminals circumferentially arranged about the input terminal comprising: a body member of an electrically nonconductive material adapted to be rotated by said driving shaft; a rotor electrode of an electrically conductive material, having opposite flat face surfaces and opposite edge surfaces, in electrical circuit arrangement with said center input terminal and supported by said body member, said rotor electrode having a tip portion which is passed in spark gap relationship with successive ones of said output terminals as said body member is rotated by said shaft; and electrically conductive paint in intimate electrical contact with a selected area along each of said opposite edge surfaces of said rotor electrode and said body member and of sufficient thickness to electrically bridge the space therebetween for electrically interconnecting said rotor electrode and said body member.

4. An ignition distributor rotor of the type which is rotated by a driving shaft within a distributor cap having a center input terminal and a plurality of output terminals circumferentially arranged about the input terminal comprising: a body member of an electrically nonconductive material adapted to be rotated by said driving shaft; a rotor electrode of an electrically conductive material in electrical circuit arrangement with said center input terminal and supported by said body member, said rotor electrode having a tip portion which is passed in spark gap relationship with successive ones of said output terminals as said body member is rotated by said shaft; and discrete electrically conductive means in bonded electrical contact with a selected area along at least one side of said rotor electrode and said body member for electrically interconnecting said rotor electrode and said body member.

* * * * *